US008893810B2

(12) United States Patent
Zimmerman et al.

(10) Patent No.: US 8,893,810 B2
(45) Date of Patent: Nov. 25, 2014

(54) ARRANGEMENT OF ISOLATION SLEEVE AND CLUSTER SLEEVES HAVING PRESSURE CHAMBERS

(75) Inventors: Patrick J. Zimmerman, Houston, TX (US); David Ward, Houston, TX (US); Cesar G Garcia, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 553 days.

(21) Appl. No.: 12/877,215

(22) Filed: Sep. 8, 2010

(65) Prior Publication Data

US 2012/0055684 A1 Mar. 8, 2012

(51) Int. Cl.

| | |
|---|---|
| ***E21B 34/00*** | (2006.01) |
| ***E21B 43/26*** | (2006.01) |
| ***E21B 43/14*** | (2006.01) |
| ***E21B 34/10*** | (2006.01) |
| ***E21B 23/04*** | (2006.01) |

(52) U.S. Cl.

CPC ..... *E21B 34/10* (2013.01); *E21B 2034/007* (2013.01); *E21B 43/26* (2013.01); *E21B 43/14* (2013.01); *E21B 23/04* (2013.01)

USPC ..... 166/386; 166/318; 166/334.4

(58) Field of Classification Search

CPC ... E21B 34/10; E21B 2034/007; E21B 21/10; E21B 23/08; E21B 34/088

USPC ..... 166/386, 373, 374, 318, 334.4, 332.4

See application file for complete search history.

(56) References Cited

U.S. PATENT DOCUMENTS

| | | | | |
|---|---|---|---|---|
| 4,520,870 | A | 6/1985 | Pringle | |
| 4,529,038 | A * | 7/1985 | Brieger | 166/312 |

(Continued)

FOREIGN PATENT DOCUMENTS

| | | |
|---|---|---|
| CA | 2776560 | 6/2011 |
| RU | 2397319 | 8/2010 |

(Continued)

OTHER PUBLICATIONS

Halliburton brochure; Completion Tools, "Delta Stim Sleeve: Designed for Selective Multi-Zone Fracturing or Acidizing Through the Completion," H04616, Sep. 2008.

(Continued)

*Primary Examiner* — Shane Bomar
*Assistant Examiner* — Kipp Wallace
(74) *Attorney, Agent, or Firm* — Wong, Cabello, Lutsch, Rutherford & Brucculeri, LLP

(57) ABSTRACT

For wellbore fluid treatment, sliding sleeves deploy on tubing in a wellbore annulus. Operators deploy a plug down the tubing to a first sleeve. The plug seats in this first sleeve, and pumped fluid pressure opens the first sleeve and communicates from the tubing to the wellbore annulus. In the annulus, the fluid pressure creates a pressure differential between the wellbore annulus pressure and a pressure chamber on second sleeves on the tubing. The resulting pressure differential opens the second sleeves so that fluid pressure from the tubing can communicate through the second open sleeves. Using this arrangement, one sleeve can be opened in a cluster of sleeves without opening all of them at the same time. The deployed plug is only required to open the fluid pressure to the annulus by opening the first sleeve. The pressure chambers actuate the second sleeves to open up the tubing to the annulus.

30 Claims, 10 Drawing Sheets

(56) References Cited

U.S. PATENT DOCUMENTS

| | | | | |
|---|---|---|---|---|
| 4,823,882 | A | 4/1989 | Stokley et al. | |
| 4,893,678 | A | 1/1990 | Stokley et al. | |
| 5,048,611 | A * | 9/1991 | Cochran | 166/374 |
| 5,146,992 | A | 9/1992 | Baugh | |
| 5,174,379 | A * | 12/1992 | Whiteley et al. | 166/278 |
| 5,244,044 | A | 9/1993 | Henderson | |
| 6,041,857 | A | 3/2000 | Carmody et al. | |
| 6,155,350 | A | 12/2000 | Melenyzer | |
| 6,349,766 | B1 | 2/2002 | Bussear et al. | |
| 6,464,008 | B1 | 10/2002 | Roddy et al. | |
| 6,634,428 | B2 | 10/2003 | Krauss et al. | |
| 6,907,936 | B2 | 6/2005 | Fehr et al. | |
| 6,920,930 | B2 | 7/2005 | Allamon et al. | |
| 7,134,505 | B2 | 11/2006 | Fehr et al. | |
| 7,347,289 | B2 | 3/2008 | Lee | |
| 7,387,165 | B2 | 6/2008 | Lopez de Cardenas et al. | |
| 2007/0272411 | A1 | 11/2007 | Lopez De Cardenas et al. | |
| 2009/0084553 | A1 | 4/2009 | Rytlewski et al. | |
| 2011/0132613 | A1* | 6/2011 | Xu | 166/318 |
| 2011/0209873 | A1* | 9/2011 | Stout | 166/320 |

FOREIGN PATENT DOCUMENTS

| | | |
|---|---|---|
| SU | 794199 | 1/1981 |
| SU | 1395809 | 5/1988 |
| WO | 2008106767 | 9/2008 |

OTHER PUBLICATIONS

Halliburton brochure; Service Tools, "Delta Stim Lite Sleeve: Designed for Selective Multi-Zone Fracturing or Acidizing Through the Completion," H06033, Jul. 2009.

DSI Brochure; "PBL-Multiple Activation Autolock Bypass Systems," obtained from http://www.dsi-pbl.com, undated.

DSI, "Autolock Bypass System," obtained from http://www.dsi-pbl.com/, generated on Oct. 28, 2009.

DSI, "Autolock Bypass System—application," obtained from http://www.dsi-pbl.com/, generated on Oct. 28, 2009.

DSI Brochure, "PBL Multiple Activation Autolock Bypass System," obtained from http://www.dsi-pbl.com/, undated.

Weatherford Brochure, "WXO and WXA Standard Sliding Sleeves," 4603.02, copyrighted 2007-2008.

Co-pending U.S. Appl. No. 12/613,633, filed Nov. 6, 2009 and entitled "Cluster Opening Sleeves for Wellbore Treatment."

First Office Action received in corresponding Australian Appl. 2011218631, mailed Feb. 28, 2013.

First Office Action received in corresponding Canadian Appl. 2,751,191, mailed Jan. 30, 2013.

Official Action received for corresponding Russian Patent Application No. 2011137068, received Nov. 14, 2012.

Second Office Action received in corresponding Canadian Appl. 2,751,191, mailed Nov. 15, 2013.

* cited by examiner

ARRANGEMENT OF ISOLATION SLEEVE AND CLUSTER SLEEVES HAVING PRESSURE CHAMBERS

BACKGROUND

In a staged frac operation, multiple zones of a formation need to be isolated sequentially for treatment. To achieve this, operators install a frac assembly down the wellbore. Typically, the assembly has a top liner packer, open hole packers isolating the wellbore into zones, various sliding sleeves, and a wellbore isolation valve. When the zones do not need to be closed after opening, operators may use single shot sliding sleeves for the frac treatment. These types of sleeves are usually ball-actuated and lock open once actuated. Another type of sleeve is also ball-actuated, but can be shifted closed after opening.

Initially, operators run the frac assembly in the wellbore with all of the sliding sleeves closed and with the wellbore isolation valve open. Operators then deploy a setting ball to close the wellbore isolation valve. This seals off the tubing string so the packers can be hydraulically set. At this point, operators rig up fracing surface equipment and pump fluid down the wellbore to open a pressure actuated sleeve so a first zone can be treated.

As the operation continues, operates drop successively larger balls down the tubing string and pump fluid to treat the separate zones in stages. When a dropped ball meets its matching seat in a sliding sleeve, the pumped fluid forces against the seated ball and shifts the sleeve open. In turn, the seated ball diverts the pumped fluid into the adjacent zone and prevents the fluid from passing to lower zones. By dropping successively increasing sized balls to actuate corresponding sleeves, operators can accurately treat each zone up the wellbore.

Because the zones are treated in stages, the lowermost sliding sleeve has a ball seat for the smallest sized ball size, and successively higher sleeves have larger seats for larger balls. In this way, a specific sized dropped ball will pass though the seats of upper sleeves and only locate and seal at a desired seat in the tubing string. Despite the effectiveness of such an assembly, practical limitations restrict the number of balls that can be run in a single tubing string. Moreover, depending on the formation and the zones to be treated, operators may need a more versatile assembly that can suit their immediate needs.

The subject matter of the present disclosure is directed to overcoming, or at least reducing the effects of, one or more of the problems set forth above.

SUMMARY

In wellbore fluid treatment such as a fracing operation, sliding sleeves deploy on a tubing string in a wellbore annulus. To isolate a zone of the wellbore, the tubing string has packing elements disposed thereon. For a given zone, the tubing string has a first isolation sleeve and one or more second cluster sleeves disposed between the packing elements. The isolation sleeve can be disposed downhole of the one or more second cluster sleeves on the tubing sting or in some other arrangement.

To treat the zone, operators deploy a plug down the tubing string to the isolation sleeve. The plug seats in an internal sleeve of this isolation sleeve, and fluid pressure pumped down the tubing string forces the first sleeve open. The diverted fluid pressure then communicates from the isolation sleeve to the wellbore annulus.

Communicated in the wellbore annulus, the fluid pressure produces a pressure differential between the wellbore annulus pressure and the pressure chambers on the cluster sleeves disposed on the tubing string. The pressure differential between the pressure chambers and the wellbore annulus then opens the cluster sleeves so that fluid pressure from the tubing string can communicate through these open sleeves.

Using this arrangement, one isolation sleeve can be opened in a cluster of sleeves without opening all of them at the same time. The ball is not required to open each sleeve of the cluster. Instead, the ball is only required to open the tubing pressure to the annulus by opening the isolation sleeve. Then, the pressure chambers actuate the cluster sleeves to open up more of the tubing string to the surrounding annulus.

To open the cluster sleeves, the fluid pressure after the isolation sleeve has been opened travels down the tubing string and into the isolated annulus of the zone. The cluster sleeves with their pressure chambers are set to withstand the hydrostatic pressure downhole within an acceptable margin. Yet, fluid pressure in the wellbore annulus equalizes with the tubing string's pressure. The pressure chambers on the cluster sleeves are actuated by the applied pressure in the annulus, and the cluster sleeves shift open so more of the isolated zone can be treated because the pressure chambers have a lower pressure.

Overall, the cluster sleeves act independent of the tubing pressure and independent of each other. In fact, each cluster sleeve in the isolated zone can be configured to open at specified pressures that can be different from or the same as other clusters sleeves in the isolated zone. Operators can ensure all of the sliding sleeves open for maximum coverage per zone and can tailor the opening according to particular purposes.

The foregoing summary is not intended to summarize each potential embodiment or every aspect of the present disclosure.

DETAILED DESCRIPTION

Figure 1:
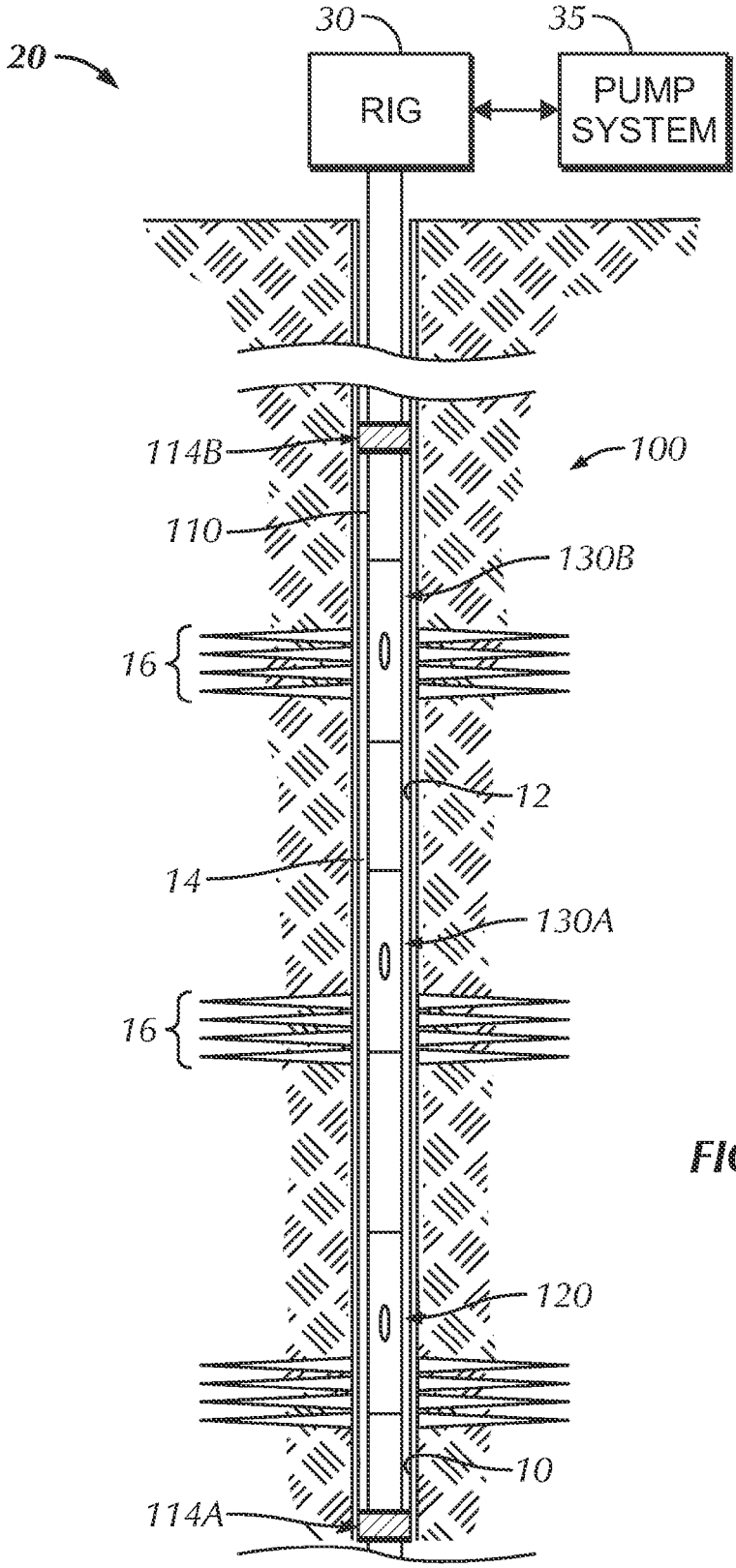
FIG. 1 diagrammatically illustrates a tubing string having multiple sliding sleeves according to the present disclosure.

A tubing string 110 shown in FIG. 1 deploys in a wellbore 10. The string 110 has an isolation sliding sleeve 120 and cluster sliding sleeves 130A-B disposed along its length. A pair of packing elements or other isolation devices 114A-B isolate portion of the wellbore 10 into an isolated zone. Disposed between the packing elements 114A-B, the sliding sleeves 120 and 130A-B can divert treatment fluid to the isolated zone of the surrounding formation. The treatment fluid can be frac fluid having proppant pumped at high pressure or can be other suitable type of fluid (with or without additive) to treat a zone of the wellbore.

The tubing string 110 can be part of a frac assembly 20, for example, having a top liner packer (not shown), a wellbore isolation valve (not shown), and other packers and sliding sleeves (not shown) in addition to those shown. Alternatively, the tubing string 110 can be part of a completion assembly or other suitable assembly. In general, the wellbore 10 can be an opened or cased hole, and the packing elements 114A-B can be any suitable type of element or packer intended to isolate portions of the wellbore into isolated zones. The wellbore 10 can be an open hole, or can have a casing. If a cased hole, the wellbore 10 can have casing perforations 16 at various points as shown.

As conventionally done for a fracing assembly 20, for example, operators deploy a setting ball to close a wellbore isolation valve (not shown) downhole, rig up fracing surface equipment (e.g., pump system 35 and the like), pump fluid down the wellbore, and open a pressure actuated sleeve (not shown) downhole so a first zone can be treated. Eventually in a later stage of the operation, operators actuate the sliding sleeves 120 and 130A-B between the packing elements 114A-B to treat the isolated zone depicted in FIG. 1.

Briefly, the isolation sleeve 120 has a seat (not shown). When operators drop a specifically sized plug (e.g., ball, dart, or the like) down the tubing string 110, the plug engages the isolation sleeve's seat. (For purposes of the present disclosure, the plug is described as a ball, although the plug can be any other acceptable device.) As fluid is pumped by the pump system 35 down the tubing string 110, the seated ball opens the isolation sleeve 120 so the pumped fluid can be diverted out ports to the surrounding wellbore 10 between the packers 114A-B.

In contrast to the isolation sleeve 120, the cluster sleeves 130A-B have pressure chambers (not shown) according to the present disclosure, which are described in more detail later. These pressure chambers are at low or atmospheric pressure, but are configured to withstand the hydrostatic pressure expected at the particular depth downhole. When the specifically sized ball is dropped down the tubing string 110 to engage the isolation sleeve 120, the dropped ball passes through the cluster sleeves 130A-B without opening them. Once the isolation sleeve 120 is opened, however, the fluid pressure pumped down the tubing string 110 enters the isolated annulus 14 of the wellbore 10 and creates a pressure differential between the wellbore annulus and the pressure chambers of the cluster sleeves 130A-B.

As pressure builds in the wellbore annulus 14, for example, the cluster sleeves 130A-B are activated by the pressure differential against their pressure chambers and any shear pins or other temporary retaining features. Eventually, the cluster sleeves 130A-B open and allow the communicated fluid in the tubing string 110 to enter the isolated annulus 14 through the open ports of these cluster sleeves 130A-B. In this way, one sized ball can be dropped down the tubing string 110 past a cluster of sliding sleeves 130A-B to treat an isolated zone. The sleeves 120 and 130A-B can divert the fluid pressure along the length of the tubing string 110 and at particular points in the wellbore 10. For example, the particular points can be adjacent certain perforations 16 if the wellbore 10 has casing 12, or they can be certain areas of the open hole if uncased.

With a general understanding of how the sliding sleeves 120 and 130A-B are used, attention now turns to further details of a tubing string, isolation sleeve, and cluster sleeves according to the present disclosure.

Figure 2:
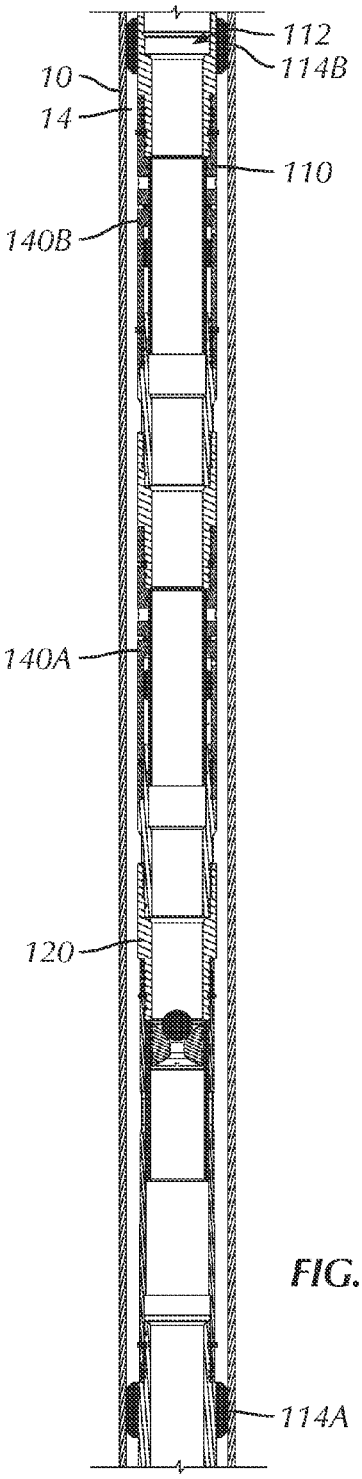
FIG. 2 shows a cross-section of one arrangement of sliding sleeves on a tubing string according to the present disclosure.

One arrangement of a tubing string 110 shown in FIG. 2 defines a through-bore 112 and has packing elements 114A-B on both ends. Although shown as packing sleeves, these elements 114A-B can be any suitable type of packing or sealing element, either active or passive, known in the art. At the downhole end, the string 110 has an isolation sleeve 120. Uphole from this, the string 110 has one or more cluster sleeves 140A-B. Although two cluster sleeves 140A-B are shown in this example, the string 110 may have any number.

Figure 3A:
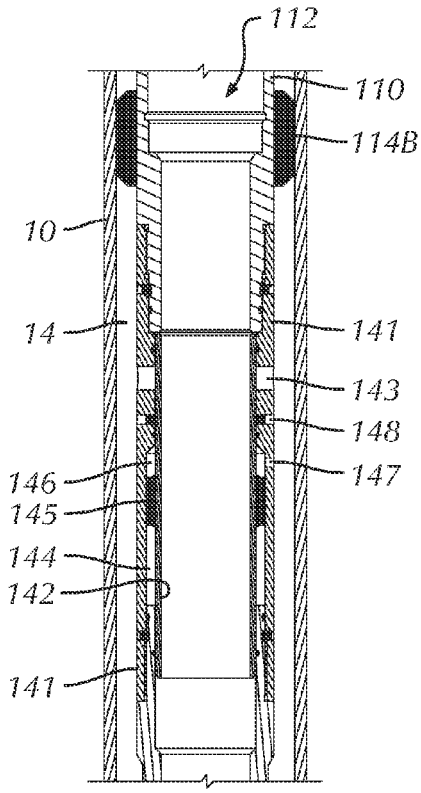
FIGS. 3A-3B show portions of the tubing string of FIG. 2, revealing details of the cluster sleeves.
Figure 3B:
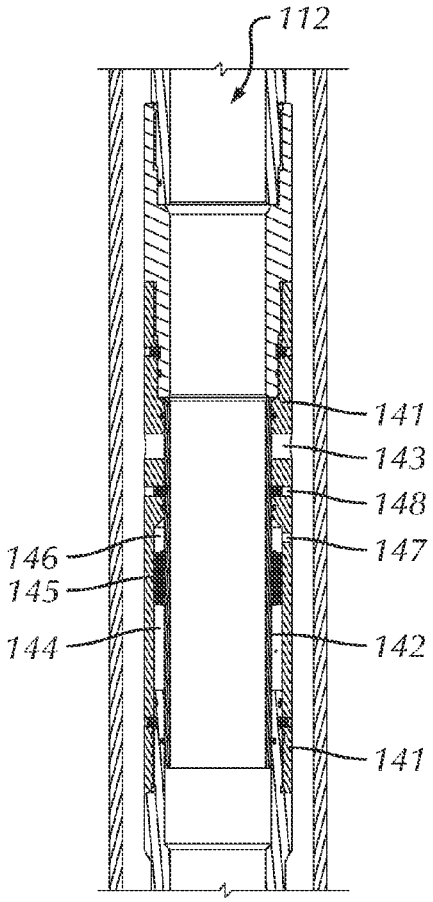
Figure 3C:
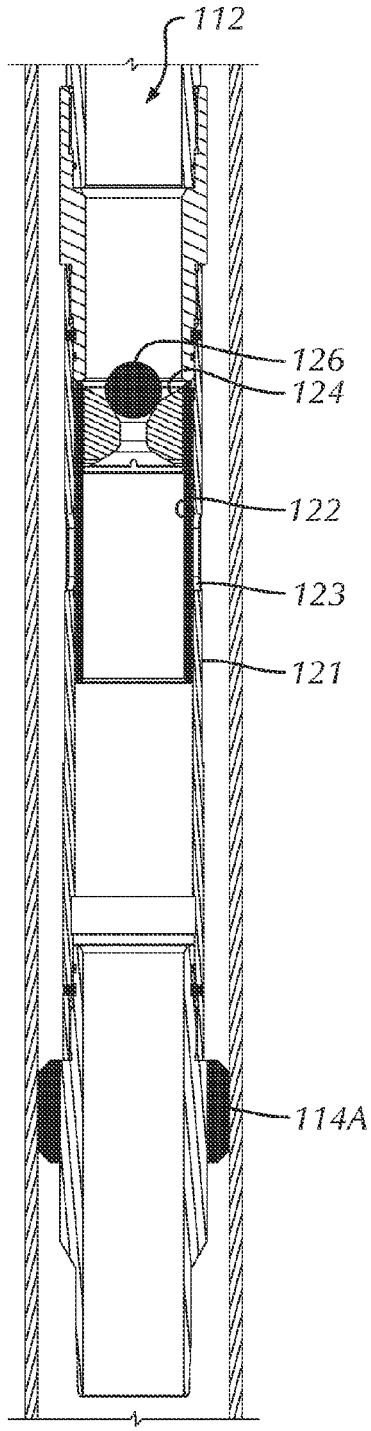
FIG. 3C show another portion of the tubing string of FIG. 2, revealing details of the isolation sleeve.

The isolation sleeve 120 shown in detail in FIG. 3C has an internal sleeve or insert 122 movably disposed in a housing 121 that forms part of the tubing string 110. This internal sleeve 122 can move relative to external ports 123 in bore of the housing 121. A seat 124 on the internal sleeve 122 engages with a dropped ball 126 or other type of plug when deployed from uphole.

The cluster sleeves 140A-B shown in FIGS. 3A-3B each have an internal sleeve or insert 142 movably disposed in a housing 141 that forms part of the tubing string 110. (The housing 141 has upper, lower, and intermediate portions that couple together, which facilitates assembly.) The internal sleeve 142 can move relative to external ports 143 in a bore of the housing 141. In the annular space between the internal sleeve 142 and the housing 141, the internal sleeve 142 defines a first (hydrostatic pressure) chamber 144 isolated from a second chamber 146 by a seal ring 125. The first chamber 144 is closed and is at a low or preset pressure, such as atmospheric. The second chamber 146 communicates with an inlet port 147 communicating with the annulus surrounding the string 12. Shear pins 148 hold the internal sleeve 142 in its closed condition covering the external ports 143.

Figure 4A:
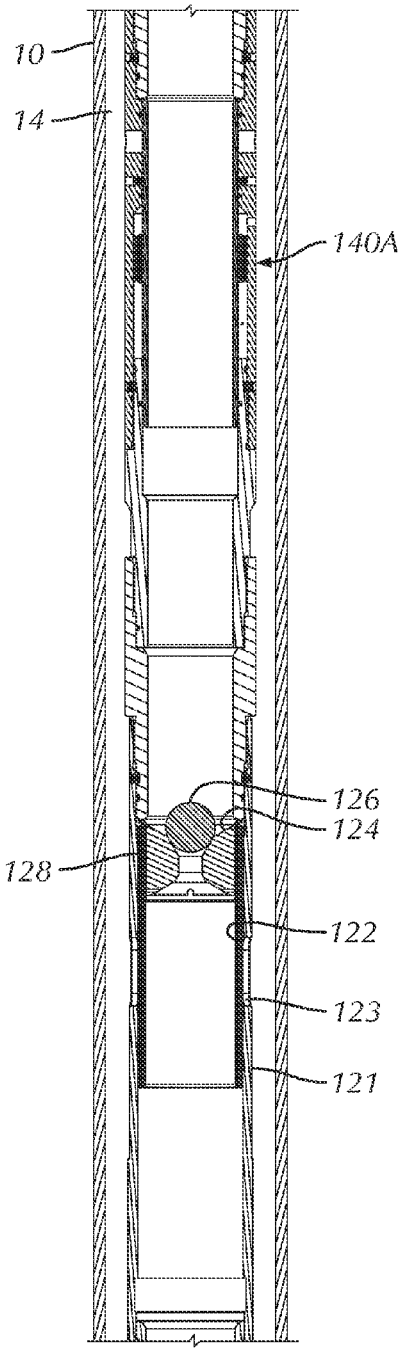
FIGS. 4A-4C show portions of the tubing string of FIG. 2 in stages of opening.
Figure 4B:
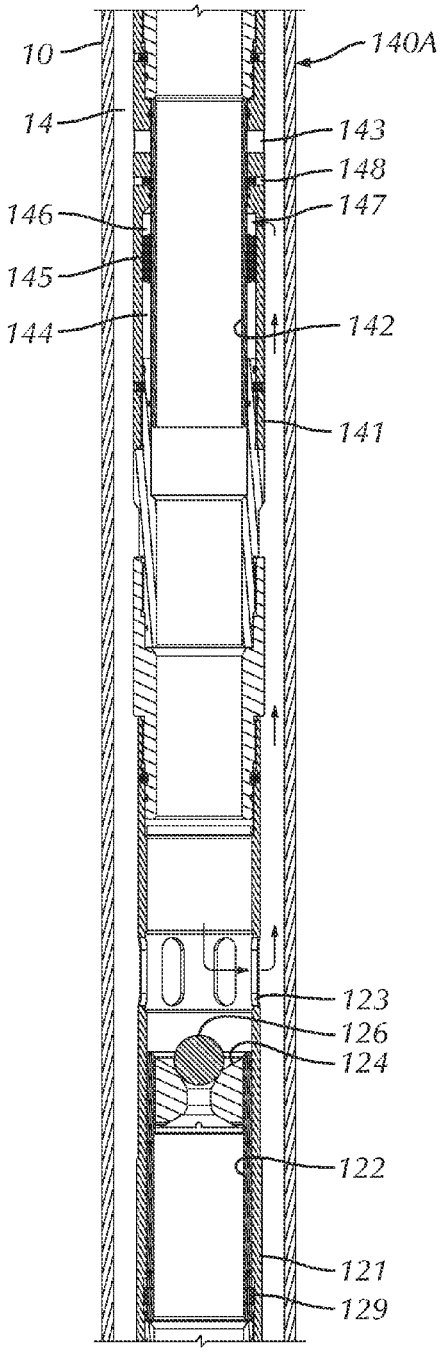
Figure 4C:
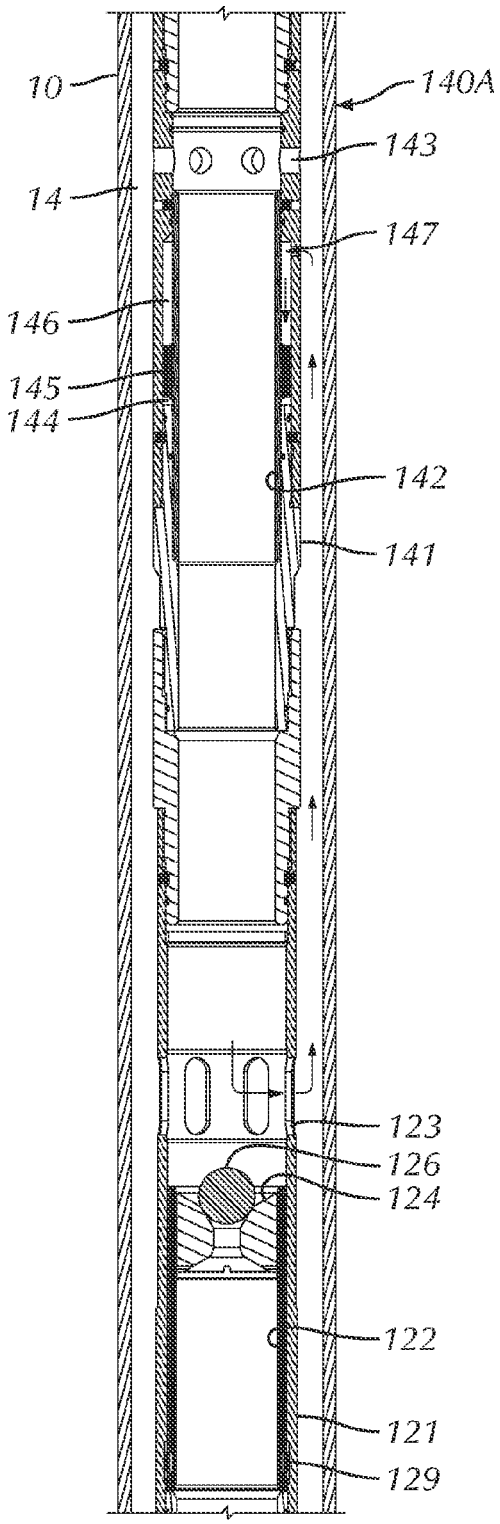

FIGS. 4A-4C show portions of the tubing string 110 in stages of opening. Initially, the isolation sleeve 120 and cluster sleeves (only one 140A shown) deploy downhole in a closed condition as shown in FIG. 4A. The packing elements (114A-B; FIG. 2A) engage the surrounding sidewall of the wellbore 10 to isolate a zone of the annulus.

To begin activating the sleeves, operators drop a suitably sized ball 126 or other type of plug down the tubing string 110. Above the present arrangement on the string 110, the dropped ball 126 may pass any number of other arrangements of similar configured sleeves for other isolated zones. However, these other arrangements have isolation sleeves configured to engage larger sized balls 126 or plugs. Therefore, the present ball 126 or plug passes through these uphole isolation sleeves without opening them.

In any event, the dropped ball 126 engages with the isolation sleeve's seat 124 as shown in FIG. 4A. The seated ball 126 now isolates the uphole portion of the string's bore 112 from any additional components downhole from the present arrangement.

At this point, operators pump fluid down the string's bore 112, and the pressure from the fluid acts against the seated ball 126. When the force reaches a configured limit, a holding ring 128, shear pins, or other affixing elements break, and the fluid pressure pushes the seated ball 126 and sleeve 122 downhole in the housing 121 as shown in FIG. 4B. As it moves, the sleeve 122 reveals the external ports 123 in the housing 121 so fluid can enter the wellbore annulus 14. As the sleeve 122 reaches its limit, dogs or a lock ring 129 on the sleeve 122 engage in a profile in the housing 121 to keep the sleeve 122 in the open condition.

The fluid pressure in the annulus 14 reaches the inlet port 147 on the cluster sleeve 140A. Pressure entering the port 147 fills the second chamber 146 and acts against the seal ring 145 on the sleeve 142. This seal ring 145 is affixed to the internal sleeve 142 and has seals engaging both the internal sleeve 142 and housing 141. As pressure fills the second chamber 146, a pressure differential develops between the first and second chambers 144 and 146. Eventually as shown in FIG. 4C, the fluid pressure breaks the shear pins 148 and forces the internal sleeve 142 downward in the housing 141. This movement reveals the exit ports 143 for the cluster sleeve 140A so that fluid pressure communicated down the tubing string 110 can enter the annulus 14 at the locations of these ports 143.

As can be seen in the present embodiment, one dropped ball 126 or other plug can be used to open multiple sliding sleeves 120/140A-B to treat a length of isolated formation. The isolation sleeve 120 is open by engagement of the ball 126 followed by application of fluid pressure. The one or more cluster sleeves 140A-B are opened subsequently once the fluid pressure in the isolated annulus 14 activates these sleeves 140A-B to open. A number of ways can be used to have the fluid pressure in the isolated annulus 14 activate the pressure chambers 144 of the cluster sleeves 140A-B. The previous embodiment used fluid pressure applied through a port 147 in the sleeve's housing 141 to create a pressure differential to move the internal sleeve 142 of the cluster sleeves 140A-B open. Another arrangement is described below with reference to FIGS. 5 through 7C.

Figure 5:
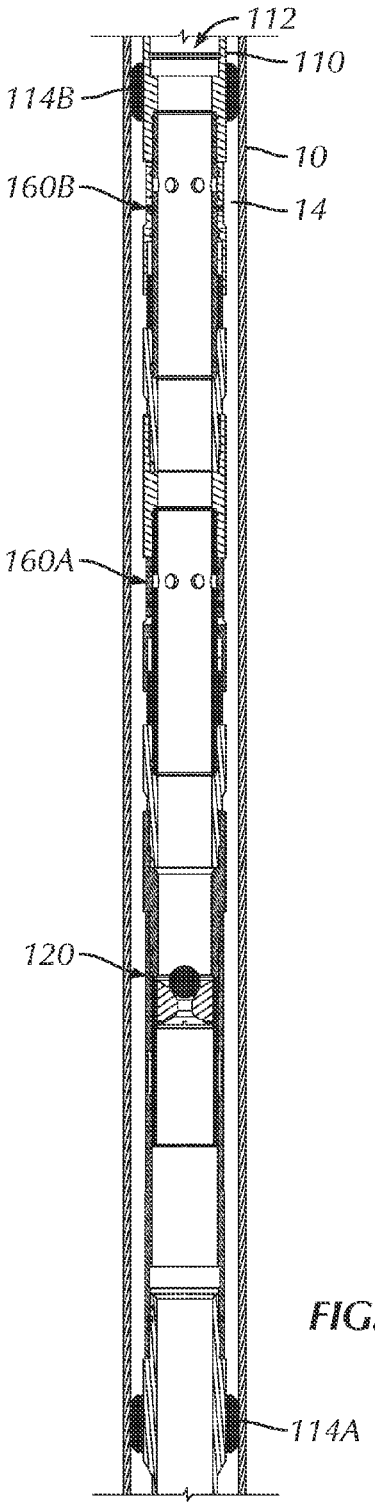
FIG. 5 shows a cross-section of another arrangement of sliding sleeves on a tubing string according to the present disclosure.

As shown in FIG. 5, the tubing string 110 again has a through-bore 112 and packing elements 114A-B as before. At the downhole end, the tubing string 110 has an isolation sleeve 120 similar to that described previously. Uphole from this, the string 110 has one or more cluster sleeves 160A-B. Although two cluster sleeves 160A-B are shown in this example, the tubing string 110 may have any number.

Figure 6A:
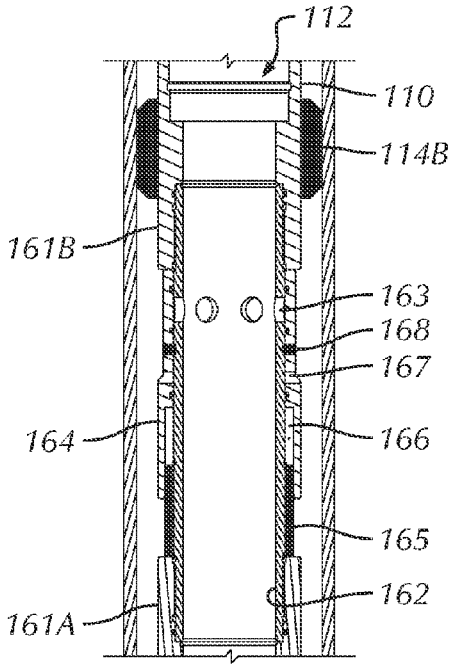
FIGS. 6A-6B show portions of the tubing string of FIG. 5, revealing details of the cluster sleeves.
Figure 6B:
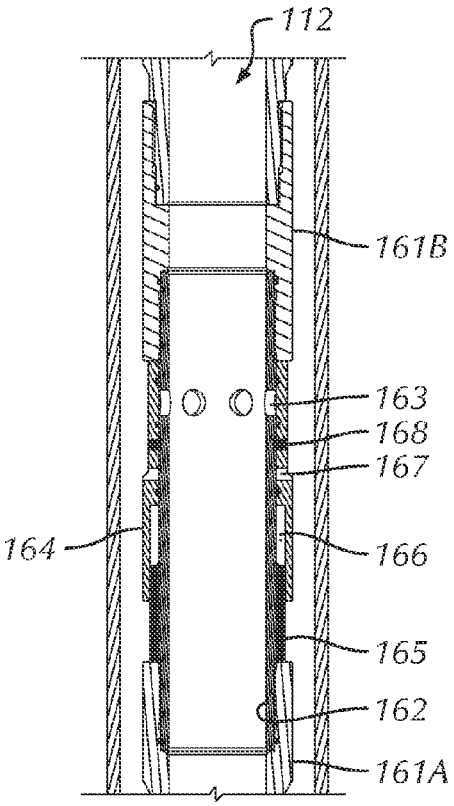
Figure 6C:
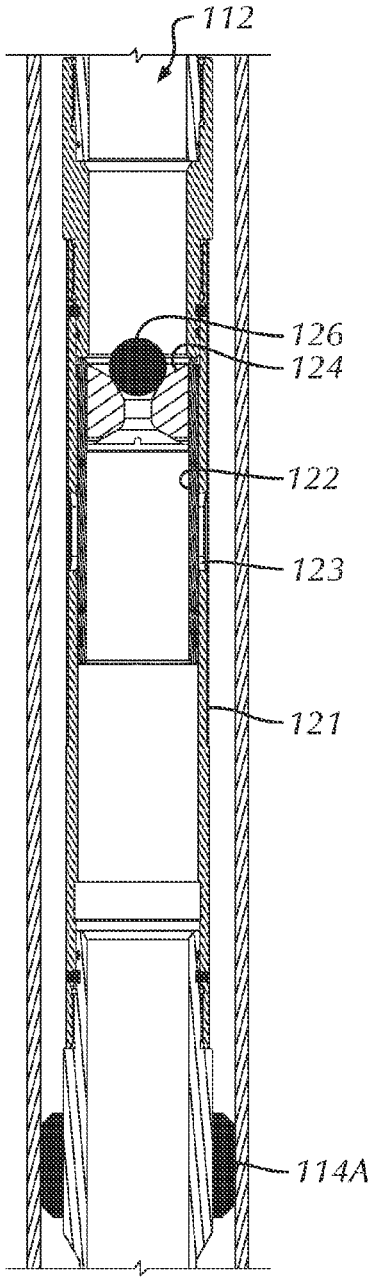
FIG. 6C show another portion of the tubing string of FIG. 5, revealing details of the isolation sleeve.

As before, the isolation sleeve 120 shown in detail in FIG. 6C has an internal sleeve 122 movably disposed in a housing 121 relative to external ports 123. A seat 124 on the internal sleeve 122 engages a dropped ball 126 or other type of plug.

The cluster sleeves 160A-B shown in FIGS. 6A-6B each have an internal sleeve 162 and an external sleeve 164. The internal sleeve 162 remains fixed between upper and lower ends 161*a-b* and defines exit ports 163. (In other words, the housing of the cluster sleeve 160A-B is formed from upper and lower ends 161*a-b* and intermediate internal sleeve 162, which facilitates assembly.)

The external sleeve 164 is disposed on the internal sleeve 162 and can move relative to the exit ports 163. The external sleeve 164 defines an isolated pressure chamber 166 in the annular space between the internal and external sleeves 162 and 164. A sealing sleeve 165 or portion of the lower housing end 161A affixes against the internal sleeve 162 and has sealing elements sealing against the internal and external sleeves 162/164. The isolated chamber 166 is sealed and is at a low or preset pressure, such as atmospheric. The external sleeve 164 defines a pressure port or shoulder 167 against which pressure can act. Finally, shear pins 148 hold the external sleeve 164 in its closed condition covering the external ports 163.

Figure 7A:
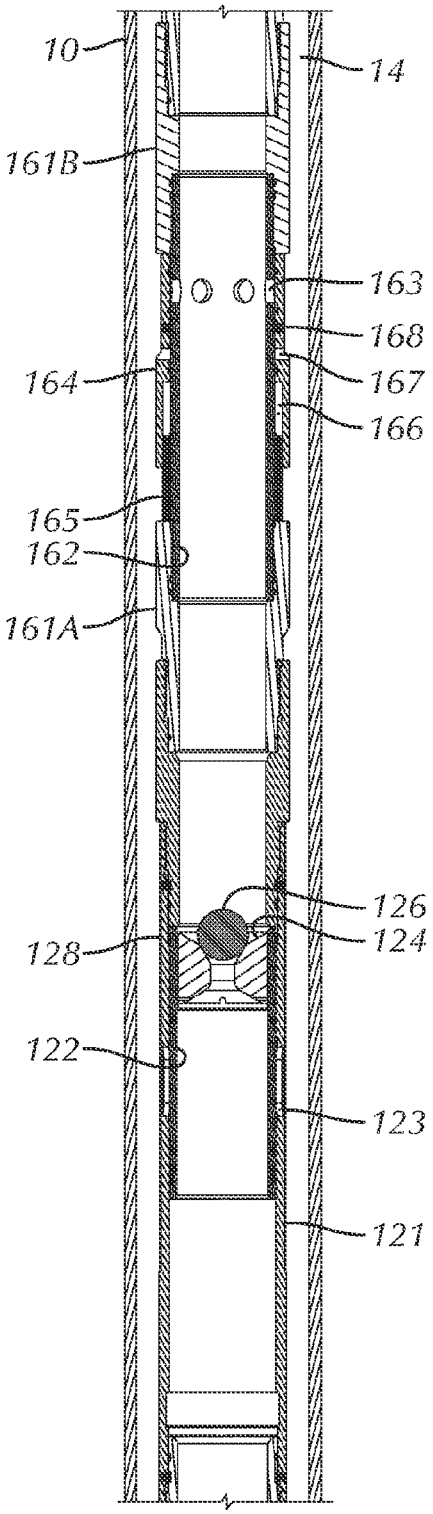
FIGS. 7A-7C show portions of the tubing string of FIG. 5 in stages of opening.
Figure 7B:
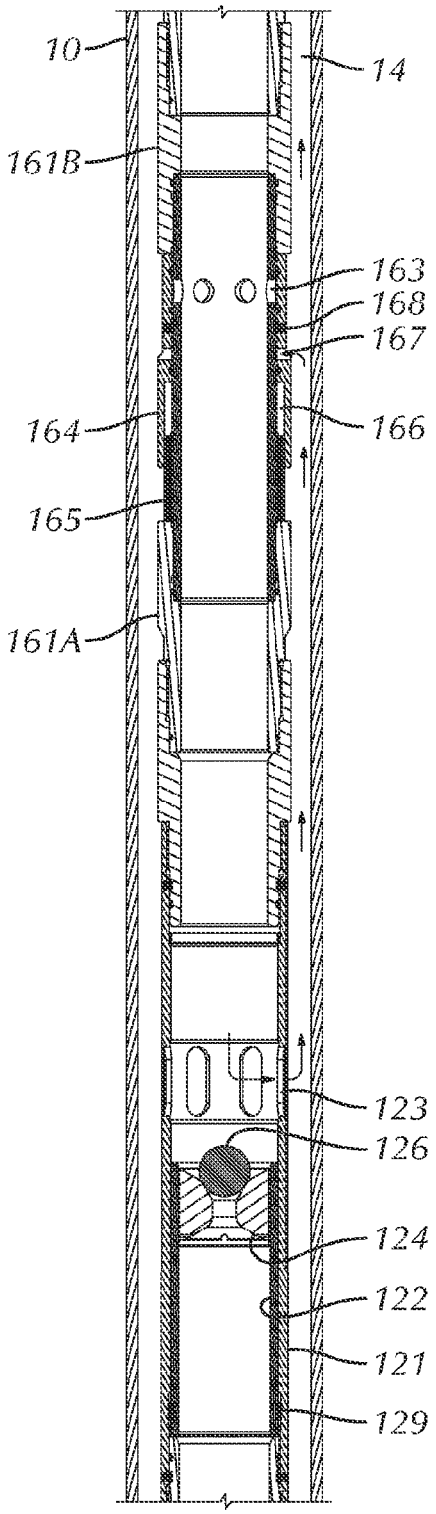
Figure 7C:
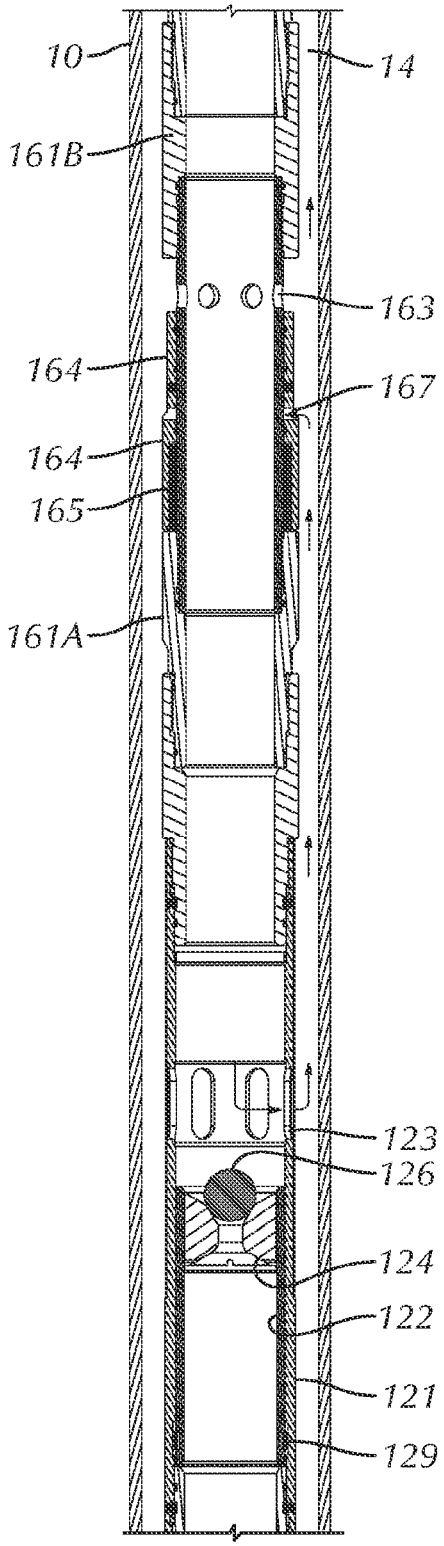

FIGS. 7A-7C show portions of the disclosed arrangement on the tubing string 110 in stages of opening. Initially, the isolation sleeve 120 and cluster sleeves (only on 160A shown) deploy downhole in a closed condition as shown in FIG. 7A. The packing elements (114A-B; FIG. 5) engage the surrounding sidewall of the wellbore 10 to isolate a zone of the formation.

To begin activating the sleeves, operators drop a suitably sized ball 126 or other type of plug down the tubing string 110. Above the present arrangement on the string 110, the dropped ball 126 may pass any number of other arrangements of similar configured sleeves for other isolated zones. However, these other arrangements have isolation sleeves configured to engage larger sized balls 126 or plugs. Therefore, the present ball 126 or plug passes through these uphole isolation sleeves without opening them.

In any event, the dropped ball 126 engages the isolation sleeve's seat 124 as shown in FIG. 7A. The seated ball 126 now isolates any additional components downhole from the present arrangement. At this point, operators pump fluid down the string's bore 112, and the pressure from the fluid acts against the seated ball 126. When the force reaches a configured limit, the holding ring 128, shear pins, or other affixing element break, and the fluid pressure pushes the seated ball 126 and sleeve 122 downhole as shown in FIG. 7B. As it moves, the sleeve 122 reveals the external ports 123 in the housing 121 so fluid can enter the well's annulus 14. The sleeve 122 reaches its limit, and a dog or lock ring 129 on the sleeve 122 engages in a profile in the housing 121.

The fluid pressure in the annulus 14 reaches the inlet port 167 on the cluster sleeve 160A. Pressure at the port 167 acts against the different sized faces or shoulders that the port 167 has on its uphole and downhole ends. In particular, the downhole face or shoulder of the port 167 has a greater surface area than the uphole face or shoulder. As the fluid pressure in the annulus 14 acts against these faces, it tends to push the external sleeve 164 downward relative to the internal sleeve 162 as the pressure differential between the wellbore annulus and pressure chamber 166 builds and acts against the sleeve 164. Eventually, the increasing pressure breaks the shear pins 168, as shown in FIG. 7B. The fluid pressure forces the external sleeve 164 downward. This movement reveals the exit ports 163 for these cluster sleeves 160A-B so that fluid communicated down the tubing string 110 can exit and enter the annulus 14 at the locations of these ports 163.

Figure 8A:
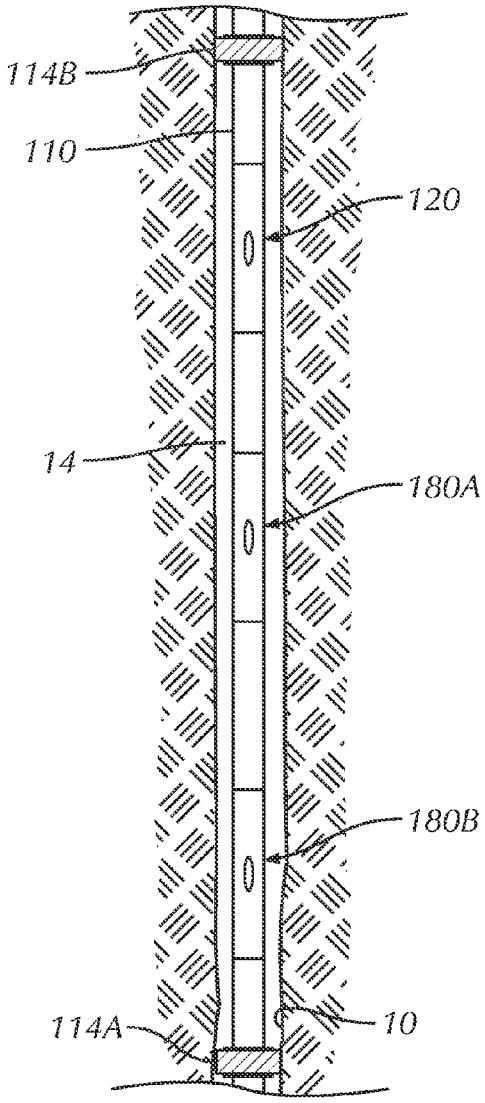
FIGS. 8A-8B diagrammatically illustrate a tubing string having alternate arrangements of sliding sleeves according to the present disclosure.

In the present arrangements, the isolation sleeve 120 disposes downhole of the cluster sleeves 130/140/160 on the tubing string 110. In another arrangement shown in FIG. 8A, the isolation sleeve 120 can be disposed uphole from the one or more cluster sleeves 180A-B in the isolated zone. When the isolation sleeve 120 seats the ball and opens, the isolated zone can be treated with the fluid pressure entering the annulus 14, while the seated ball prevents further fluid pressure to communicate down the tubing string 110. The cluster sleeve 180A-B can then be configured to open when a desired pressure in the wellbore annulus 14 is reached. At this point, fluid leaving the isolation sleeve 120 can re-enter the tubing string 110 via the one or more cluster sleeves 180A-B, which are now open and acting as a crossover below the isolation sleeve 120.

Figure 8B:
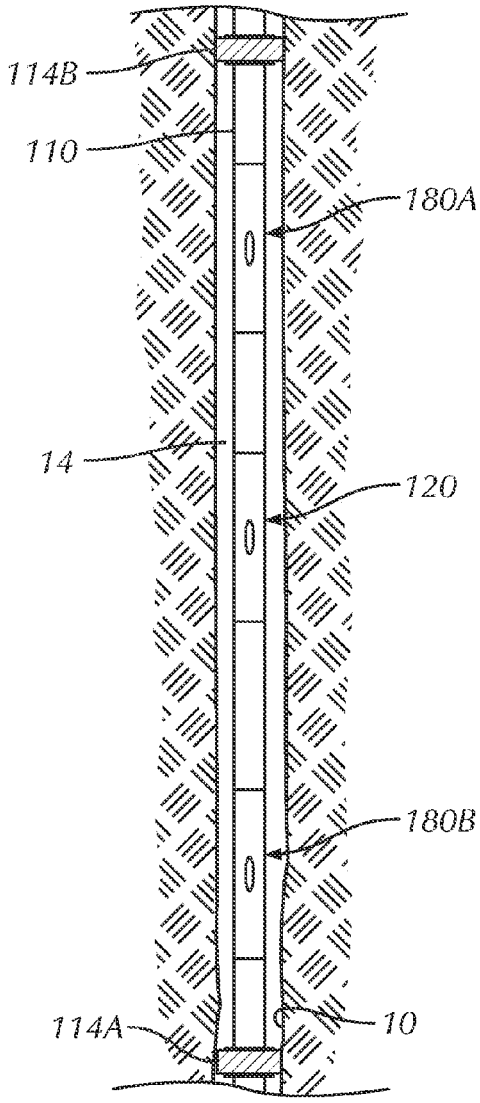

It is further conceivable that a given zone can have an isolation sleeve 120 disposed between uphole and downhole cluster sleeves 180A-B. As shown in FIG. 8B, the isolation sleeve 120 can be disposed between uphole and downhole cluster sleeves 180A-B in the isolated zone. When the isolation sleeve 120 seats the ball and opens, the isolated zone can be treated with the fluid pressure entering the annulus 14, while the seated ball prevents further fluid pressure to communicate down the tubing string 110. The uphole cluster sleeve 180A can be configured to open when a desired pressure in the wellbore annulus 14 is reached so more of the isolated zone can be treated.

At the same pressure or at a higher pressure, the downhole cluster sleeve 180B can be configured to open when a desired pressure in the wellbore annulus 14 is reached. At this point fluid leaving the isolation sleeve 120 can re-enter the tubing string 110 via the downhole cluster sleeve 180B, which is now open and acting as a crossover. These and other combinations of isolation sleeves, cluster sleeves, packing elements, and pressure differentials according to the present disclosure may be advantageous for various reasons in a wellbore.

In addition to the above-arrangements, it will be appreciated with the benefit of the present disclosure that an isolated zone of a tubing string in a wellbore can have one or more cluster sleeves (140/160/180) disposed thereon along with more than one isolation sleeve (120) as well. Moreover, it will be appreciated with the benefit of the present disclosure that a tubing string (or an isolated section of a tubing string) in a wellbore can have one or more cluster sleeves (140/160/180) disposed thereon without having an isolating sleeve (120). For example, the arrangements of cluster sleeves 130, 140, 160, and 180 in FIGS. 1, 2, 5, and 8A-8B may lack an isolating sleeve 120 disposed on the string 110. For such an arrangement of cluster sleeves 130, 140, 160, and 180 to open, fluid pressure is applied to the wellbore annulus by any suitable technique available in the art (e.g., by using a mechanically shifted sliding sleeve or a ported housing, by pumping fluid pressure down the wellbore annulus, etc.). In other words, for example, the isolation sleeve 120 in any of FIGS. 1, 2, 5, and 8A-8B could be a mechanically shifted sliding sleeve, a ported housing, or the like. With the benefit of the present disclosure, it will be appreciated that the disclosed sliding sleeves can be used in these and other arrangements.

The foregoing description of preferred and other embodiments is not intended to limit or restrict the scope or applicability of the inventive concepts conceived of by the Applicants. As can be seen from the cluster sleeves disclosed above, the cluster sleeve includes a movable sleeve that can move from a closed condition to an open condition relative to an outlet. The movable sleeve can be an internal sleeve or insert (e.g., 142; FIG. 3A) or an external sleeve (e.g., 164; FIG. 6A). This movable sleeve (142/162) is set to the closed condition and has a pressure chamber. In either case, the movable sleeve (142/162) moves from the closed condition to the open condition in response to a pressure differential between the wellbore annulus pressure and the pressure chamber (and any shear pins or other retainers if applicable). With the sleeve moved open, fluid pressure can communicate from the tubing string to the wellbore annulus through the outlet that had been previously covered by the movable sleeve. In general, each cluster sleeve 180 can be configured to open in response to a same or different pressure differential compared to the other cluster sleeves on the tubing string.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A wellbore fluid treatment method, comprising:

deploying a plurality of sliding sleeves on a tubing string in a wellbore annulus, the sliding sleeves at least including a first sliding sleeve and at least one second sliding sleeve;

opening a first housing outlet associated with the first sliding sleeve to communicate fluid pressure from the tubing string to the wellbore annulus by deploying a first plug down the tubing string and pumping fluid pressure in the tubing string;

communicating fluid pressure from the tubing string to the wellbore annulus by passing fluid through the open first housing outlet associated with the first sliding sleeve;

opening at least one second housing outlet associated with the at least one second sliding sleeve by applying fluid pressure communicated in the wellbore annulus from the first sliding sleeve relative to a pressure chamber on the at least one second sliding sleeve; and communicating fluid pressure from the tubing string to the wellbore annulus by passing fluid through the at least one open second housing outlet associated with the at least one second sliding sleeve.

2. The method of claim 1, wherein deploying the plurality of sliding sleeves comprises isolating the wellbore annulus uphole and downhole of the plurality of sliding sleeves on the tubing string.

3. The method of claim 2, wherein isolating the wellbore annulus comprises engaging packing elements on the tubing string uphole and downhole of the sliding sleeves against a sidewall of the wellbore.

4. The method of claim 1, wherein deploying the sliding sleeves comprises deploying the at least one second sliding sleeve uphole of the first sliding sleeve on the tubing string.

5. The method of claim 1, wherein the first sliding sleeve comprises:

a movable sleeve being movable from a closed condition to an open condition relative to the first housing outlet; and a seat disposed on the movable sleeve and engaging with the first plug when deployed down the tubing string, the movable sleeve moving to the open condition in response to fluid pressure applied against the seated first plug.

6. The method of claim 1, wherein the at least one second sliding sleeve comprises:

a movable sleeve being movable from a closed condition to an open condition relative to the at least one second housing outlet, the movable sleeve moving from the closed condition to the open condition in response to a pressure differential between the wellbore annulus and the pressure chamber, the movable sleeve in the open condition permitting fluid pressure from the tubing string to communicate to the wellbore annulus through the at least one second housing outlet.

7. The method of claim 1, wherein opening the first housing outlet associated with the first sliding sleeve to communicate fluid pressure from the tubing string with the wellbore annulus comprises:

engaging the deployed first plug on a seat of a movable sleeve of the first sliding sleeve; and moving the movable sleeve open relative to the first housing outlet associated with the first sliding sleeve with fluid pressure applied against the seated first plug.

8. The method of claim 1, wherein opening the at least one second housing outlet associated with at least one second sliding sleeve comprises:

creating a pressure differential between the wellbore annulus and the pressure chamber of a movable sleeve on the at least one second sliding sleeve; and moving the movable sleeve open relative to the second housing outlet associated with the at least one second sliding sleeve in response to the created pressure differential.

9. The method of claim 8, wherein creating the pressure differential comprises applying the fluid pressure in the wellbore annulus against the movable sleeve to act against the pressure chamber.

10. The method of claim 1, wherein deploying the sliding sleeves comprise deploying a third sliding sleeve and at least one fourth sliding sleeve uphole from the first sliding sleeve and the at least one second sliding sleeve.

11. The method of claim 10, wherein deploying the sliding sleeves comprises isolating the third sliding sleeve and the at least one fourth sliding sleeves from the first sliding sleeve and the at least one second sliding sleeve in the wellbore annulus.

12. The method of claim 10, wherein the method further comprises:

opening the third sliding sleeve to communicate fluid pressure from the tubing string to the wellbore annulus by deploying a second plug down the tubing string and pumping fluid pressure in the tubing string; and opening the at least one fourth sliding sleeve by applying fluid pressure in the wellbore annulus relative to a pressure chamber on the at least one fourth sliding sleeve.

13. The method of claim 1, wherein the tubing string comprises a plurality of the at least one second sliding sleeves, each of the second sliding sleeves having a pressure chamber and each opening in response to a same or different pressure differential between the wellbore annulus and the pressure chamber.

14. A wellbore fluid treatment method, comprising:

deploying a plurality of sliding sleeves on a tubing string in a wellbore annulus, the sliding sleeves at least including a first sliding sleeve and at least one second sliding sleeve;

seating a plug in the first sliding sleeve;

pumping fluid pressure in the tubing string;

opening a first housing outlet associated with the first sliding sleeve with fluid pressure applied against the seated plug in the first sliding sleeve;

communicating fluid pressure to the wellbore annulus by passing fluid through the open first housing outlet associated with the first sliding sleeve;

applying fluid pressure in the wellbore annulus communicated from the open first sliding sleeve relative to a pressure chamber on the at least one second sliding sleeve;

opening at least one second housing outlet associated with the at least one second sliding sleeve with a pressure differential between the pressure chamber and the wellbore annulus; and communicating fluid pressure to the wellbore annulus by passing fluid through the at least one open second housing outlet associated with the at least one sliding sleeve.

15. The method of claim 14, wherein deploying the plurality of sliding sleeves comprises isolating the wellbore annulus uphole and downhole of the plurality of sliding sleeves on the tubing string.

16. The method of claim 14, wherein deploying the sliding sleeves comprises deploying the at least one second sliding sleeve uphole of the first sliding sleeve on the tubing string.

17. The method of claim 14, wherein opening the first housing outlet associated with the first sliding sleeve comprises:

engaging the seated first plug on a seat of a movable sleeve of the first sliding sleeve; and moving the movable sleeve open relative to the first housing outlet associated with the first sliding sleeve with fluid pressure applied against the seated first plug.

18. The method of claim 14, wherein opening the at least one second housing outlet associated with the at least one second sliding sleeve comprises:

creating the pressure differential between the wellbore annulus and the pressure chamber of a movable sleeve on the at least one second sliding sleeve; and moving the movable sleeve open relative to the second housing outlet associated with the at least one second sliding sleeve in response to the created pressure differential.

19. The method of claim 18, wherein creating the pressure differential comprises applying the fluid pressure in the wellbore annulus against the movable sleeve to act against the pressure chamber.

20. The method of claim 14, wherein the tubing string comprises a plurality of the at least one second sliding sleeves, each of the second sliding sleeves having a pressure chamber and each opening in response to a same or different pressure differential between the wellbore annulus and the pressure chamber.

21. A wellbore fluid treatment apparatus, comprising:

a first sliding sleeve disposing on a tubing string in a wellbore and having a first housing outlet, the first sliding sleeve opening the first housing outlet in response to fluid pressure applied down the tubing string, the open first sliding sleeve passing fluid out the open first housing outlet and communicating fluid pressure from the tubing string to a wellbore annulus through the open first housing outlet associated with the first sliding sleeve; and at least one second sliding sleeve disposing on the tubing string in the wellbore, the at least one second sliding sleeve having a second housing outlet associated with and having a pressure chamber, the at least one second sliding sleeve opening the second housing outlet in response to a pressure differential between the pressure chamber and fluid pressure communicated in the wellbore annulus by the first sliding sleeve, the at least one open second sliding sleeve passing fluid out the open second housing outlet and communicating fluid pressure from the tubing string to the wellbore annulus through the open second housing outlet associated with the at least one second sliding sleeve.

22. The apparatus of claim 21, further comprising at least one packing element disposing on the tubing string in the wellbore, the at least one packing element isolating the wellbore annulus around the first and second sliding sleeves from other portions of the wellbore.

23. The apparatus of claim 21, wherein the first sliding sleeve comprises:

a movable sleeve being movable from a closed condition to an open condition relative to the first housing outlet; and a seat disposed on the movable sleeve and engaging with a plug when deployed down the tubing string, the movable sleeve moving to the open condition in response to fluid pressure applied against the seated plug.

24. The apparatus of claim 21, wherein the at least one second sliding sleeve disposes uphole of the first sliding sleeve on the tubing string.

25. The apparatus of claim 21, wherein the at least one second sliding sleeve comprises:

a movable sleeve being movable from a closed condition to an open condition relative to the second housing outlet, the movable sleeve moving from the closed condition to the open condition in response to the pressure differential between the wellbore annulus and the pressure chamber, the movable sleeve in the open condition permitting fluid pressure from the tubing string to communicate to the wellbore annulus through the second housing outlet.

26. The apparatus of claim 25, wherein the pressure chamber is defined between the movable sleeve and a housing portion of the at least one second sliding sleeve.

27. The apparatus of claim 26, wherein the fluid pressure in the wellbore annulus acts against the movable sleeve.

28. The apparatus of claim 25, wherein the movable sleeve comprises an internal sleeve movably disposed in a bore of a housing of the at least one second sliding sleeve, the housing defining the second housing outlet.

29. The apparatus of claim 25, wherein the movable sleeve comprises an external sleeve movably disposed on a housing of the at least one second sliding sleeve, the housing defining the second housing outlet.

30. The apparatus of claim 21, further comprising at least one third sliding sleeve disposing on the tubing string in the wellbore, the at least one third sliding sleeve having a third housing outlet and having another pressure chamber, the at least one third sliding sleeve opening the third housing outlet in response to a same or different pressure differential between the wellbore annulus and the pressure chamber.

* * * * *